US009711156B2

(12) United States Patent
Atti et al.

(10) Patent No.: US 9,711,156 B2
(45) Date of Patent: Jul. 18, 2017

(54) SYSTEMS AND METHODS OF PERFORMING FILTERING FOR GAIN DETERMINATION

(71) Applicant: QUALCOMM Incorporated, San Diego, CA (US)

(72) Inventors: Venkatraman Srinivasa Atti, San Diego, CA (US); Venkatesh Krishnan, San Diego, CA (US); Vivek Rajendran, San Diego, CA (US); Stephane Pierre Villette, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 155 days.

(21) Appl. No.: 13/959,188

(22) Filed: Aug. 5, 2013

(65) Prior Publication Data

US 2014/0229171 A1 Aug. 14, 2014

Related U.S. Application Data

(60) Provisional application No. 61/762,807, filed on Feb. 8, 2013.

(51) Int. Cl.
*G10L 21/038* (2013.01)
*G10L 19/03* (2013.01)
(Continued)

(52) U.S. Cl.
CPC ..... *G10L 19/03* (2013.01); *G10L 19/24* (2013.01); *G10L 21/0208* (2013.01);
(Continued)

(58) Field of Classification Search
CPC ..... G10L 19/03
(Continued)

(56) References Cited

U.S. PATENT DOCUMENTS 6,263,307 B1 7/2001 Arslan et al.
6,453,289 B1 9/2002 Ertem et al.
(Continued)

FOREIGN PATENT DOCUMENTS

WO 2012158157 A1 11/2012

OTHER PUBLICATIONS

Hsu, W., "Robust Bandwidth Extension of Narrowband Speech", Masters Thesis, Department of Electrical & Computer Engineering, McGill University, Montreal, Canada, Nov. 2004, 76 pages.
(Continued)

*Primary Examiner* — David Hudspeth
*Assistant Examiner* — Shreyans Patel
(74) *Attorney, Agent, or Firm* — Toler Law Group, PC

(57) ABSTRACT

A particular method includes determining, based on spectral information corresponding to an audio signal that includes a low-band portion and a high-band portion, that the audio signal includes a component corresponding to an artifact-generating condition. The method also includes filtering the high-band portion of the audio signal and generating an encoded signal. Generating the encoded signal includes determining gain information based on a ratio of a first energy corresponding to filtered high-band output to a second energy corresponding to the low-band portion to reduce an audible effect of the artifact-generating condition.

40 Claims, 8 Drawing Sheets

(51) Int. Cl.

| | |
|---|---|
| ***G10L 21/0388*** | (2013.01) |
| ***G10L 19/24*** | (2013.01) |
| ***G10L 21/0208*** | (2013.01) |
| *G10L 21/0216* | (2013.01) |
| *G10L 19/07* | (2013.01) |

(52) U.S. Cl.
CPC ..... *G10L 21/0388* (2013.01); *G10L 19/07* (2013.01); *G10L 21/0216* (2013.01)

(58) Field of Classification Search
USPC ..... 704/225
See application file for complete search history.

(56) References Cited

U.S. PATENT DOCUMENTS

2004/0049380 A1 3/2004 Ehara et al.
2005/0004793 A1* 1/2005 Ojala ..... G10L 21/038 704/219
2006/0147124 A1 7/2006 Edler et al.
2008/0027716 A1* 1/2008 Rajendran ..... G10L 19/012 704/210
2009/0192803 A1* 7/2009 Nagaraja ..... G10L 19/012 704/278
2009/0254783 A1 10/2009 Hirschfeld et al.
2010/0036656 A1* 2/2010 Kawashima ..... G10L 21/0364 704/205
2010/0241433 A1 9/2010 Herre et al.
2011/0099004 A1* 4/2011 Krishnan ..... G10L 21/038 704/206
2012/0101824 A1 4/2012 Chen
2012/0221326 A1 8/2012 Grancharov et al.

OTHER PUBLICATIONS

International Search Report and Written Opinion for International Application No. PCT/US2013/053806, Mailed on Dec. 20, 2013, 11 pages.

* cited by examiner

SYSTEMS AND METHODS OF PERFORMING FILTERING FOR GAIN DETERMINATION

I. CROSS-REFERENCE TO RELATED APPLICATIONS

The present application claims priority from commonly owned U.S. Provisional Patent Application No. 61/762,807 filed on Feb. 8, 2013, the content of which is expressly incorporated herein by reference in its entirety.

II. FIELD

The present disclosure is generally related to signal processing.

III. DESCRIPTION OF RELATED ART

Advances in technology have resulted in smaller and more powerful computing devices. For example, there currently exist a variety of portable personal computing devices, including wireless computing devices, such as portable wireless telephones, personal digital assistants (PDAs), and paging devices that are small, lightweight, and easily carried by users. More specifically, portable wireless telephones, such as cellular telephones and Internet Protocol (IP) telephones, can communicate voice and data packets over wireless networks. Further, many such wireless telephones include other types of devices that are incorporated therein. For example, a wireless telephone can also include a digital still camera, a digital video camera, a digital recorder, and an audio file player.

In traditional telephone systems (e.g., public switched telephone networks (PSTNs)), signal bandwidth is limited to the frequency range of 300 Hertz (Hz) to 3.4 kiloHertz (kHz). In wideband (WB) applications, such as cellular telephony and voice over internet protocol (VoIP), signal bandwidth may span the frequency range from 50 Hz to 7 kHz. Super wideband (SWB) coding techniques support bandwidth that extends up to around 16 kHz. Extending signal bandwidth from narrowband telephony at 3.4 kHz to SWB telephony of 16 kHz may improve the quality of signal reconstruction, intelligibility, and naturalness.

SWB coding techniques typically involve encoding and transmitting the lower frequency portion of the signal (e.g., 50 Hz to 7 kHz, also called the "low-band"). For example, the low-band may be represented using filter parameters and/or a low-band excitation signal. However, in order to improve coding efficiency, the higher frequency portion of the signal (e.g., 7 kHz to 16 kHz, also called the "high-band") may not be fully encoded and transmitted. Instead, a receiver may utilize signal modeling to predict the high-band. In some implementations, data associated with the high-band may be provided to the receiver to assist in the prediction. Such data may be referred to as "side information," and may include gain information, line spectral frequencies (LSFs, also referred to as line spectral pairs (LSPs)), etc. High-band prediction using a signal model may be acceptably accurate when the low-band signal is sufficiently correlated to the high-band signal. However, in the presence of noise, the correlation between the low-band and the high-band may be weak, and the signal model may no longer be able to accurately represent the high-band. This may result in artifacts (e.g., distorted speech) at the receiver.

IV. SUMMARY

Systems and methods of performing conditional filtering of an audio signal for gain determination in an audio coding system are disclosed. The described techniques include determining whether an audio signal to be encoded for transmission includes a component (e.g., noise) that may result in audible artifacts upon reconstruction of the audio signal. For example, the underlying signal model may interpret the noise as speech data, which may result in an erroneous reconstruction of the audio signal. In accordance with the described techniques, in the presence of artifact-inducing components, conditional filtering may be performed to a high-band portion of the audio signal and the filtered high-band output may be used to generate gain information for the high-band portion. The gain information based on the filtered high-band output may lead to reduced audible artifacts upon reconstruction of the audio signal at a receiver.

In a particular embodiment, a method includes determining, based on spectral information corresponding to an audio signal that includes a low-band portion and a high-band portion, that the audio signal includes a component corresponding to an artifact-generating condition. The method also includes filtering the high-band portion of the audio signal to generate a filtered high-band output. The method further includes generating an encoded signal. Generating the encoded signal includes determining gain information based on a ratio of a first energy corresponding to the filtered high-band output to a second energy corresponding to the low-band portion to reduce an audible effect of the artifact-generating condition.

In a particular embodiment, a method includes comparing an inter-line spectral pair (LSP) spacing associated with a frame of an audio signal to at least one threshold. The method also includes conditional filtering of a high-band portion of the audio signal to generate a filtered high-band output based at least partially on the comparing. The method includes determining gain information based on a ratio of a first energy corresponding to the filtered high-band output to a second energy corresponding to a low-band portion of the audio signal.

In another particular embodiment, an apparatus includes a noise detection circuit configured to determine, based on spectral information corresponding to an audio signal that includes a low-band portion and a high-band portion, that the audio signal includes a component corresponding to an artifact-generating condition. The apparatus includes a filtering circuit responsive to the noise detection circuit and configured to filter the high-band portion of the audio signal to generate a filtered high-band output. The apparatus also includes a gain determination circuit configured to determine gain information based on a ratio of a first energy corresponding to the filtered high-band output to a second energy corresponding to the low-band portion to reduce an audible effect of the artifact-generating condition.

In another particular embodiment, an apparatus includes means for determining, based on spectral information corresponding to an audio signal that includes a low-band portion and a high-band portion, that the audio signal includes a component corresponding to an artifact-generating condition. The apparatus also includes means for filtering a high-band portion of the audio signal to generate a filtered high-band output. The apparatus includes means for generating an encoded signal. The means for generating the encoded signal includes means for determining gain information based on a ratio of a first energy corresponding to the filtered high-band output to a second energy corresponding to the low-band portion to reduce an audible effect of the artifact-generating condition.

In another particular embodiment, a non-transitory computer-readable medium includes instructions that, when executed by a computer, cause the computer to determine, based on spectral information corresponding to an audio signal that includes a low-band portion and a high-band portion, that the audio signal includes a component corresponding to an artifact-generating condition, to filter the high-band portion of the audio signal to generate a filtered high-band output, and to generate an encoded signal. Generating the encoded signal includes determining gain information based on a ratio of a first energy corresponding to the filtered high-band output to a second energy corresponding to the low-band portion to reduce an audible effect of the artifact-generating condition.

Particular advantages provided by at least one of the disclosed embodiments include an ability to detect artifact-inducing components (e.g., noise) and to selectively perform filtering in response to detecting such artifact-inducing components to affect gain information, which may result in more accurate signal reconstruction at a receiver and fewer audible artifacts. Other aspects, advantages, and features of the present disclosure will become apparent after review of the entire application, including the following sections: Brief Description of the Drawings, Detailed Description, and the Claims.

V. BRIEF DESCRIPTION OF THE DRAWINGS

VI. DETAILED DESCRIPTION

Figure 1:
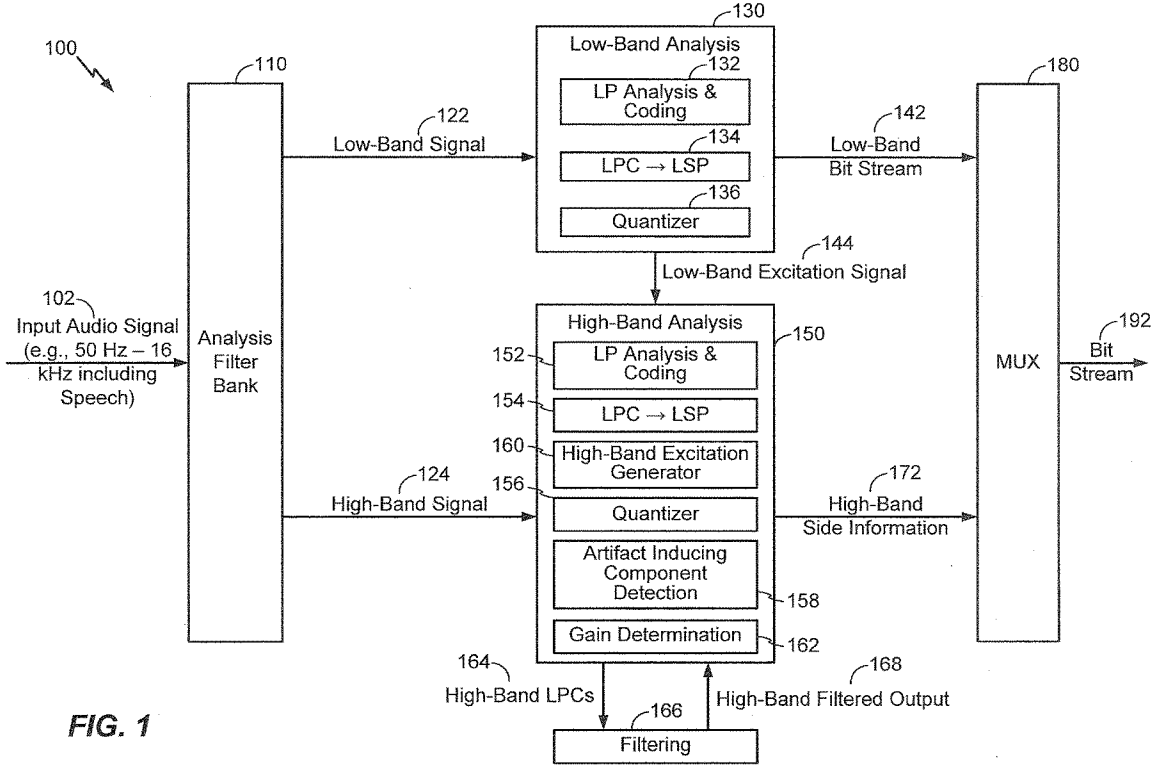
FIG. 1 is a diagram to illustrate a particular embodiment of a system that is operable to perform filtering.

Referring to FIG. 1, a particular embodiment of a system that is operable to perform filtering is shown and generally designated 100. In a particular embodiment, the system 100 may be integrated into an encoding system or apparatus (e.g., in a wireless telephone or coder/decoder (CODEC)).

It should be noted that in the following description, various functions performed by the system 100 of FIG. 1 are described as being performed by certain components or modules. However, this division of components and modules is for illustration only. In an alternate embodiment, a function performed by a particular component or module may instead be divided amongst multiple components or modules. Moreover, in an alternate embodiment, two or more components or modules of FIG. 1 may be integrated into a single component or module. Each component or module illustrated in FIG. 1 may be implemented using hardware (e.g., a field-programmable gate array (FPGA) device, an application-specific integrated circuit (ASIC), a digital signal processor (DSP), a controller, etc.), software (e.g., instructions executable by a processor), or any combination thereof.

The system 100 includes an analysis filter bank 110 that is configured to receive an input audio signal 102. For example, the input audio signal 102 may be provided by a microphone or other input device. In a particular embodiment, the input audio signal 102 may include speech. The input audio signal may be a super wideband (SWB) signal that includes data in the frequency range from approximately 50 hertz (Hz) to approximately 16 kilohertz (kHz). The analysis filter bank 110 may filter the input audio signal 102 into multiple portions based on frequency. For example, the analysis filter bank 110 may generate a low-band signal 122 and a high-band signal 124. The low-band signal 122 and the high-band signal 124 may have equal or unequal bandwidths, and may be overlapping or non-overlapping. In an alternate embodiment, the analysis filter bank 110 may generate more than two outputs.

The low-band signal 122 and the high-band signal 124 may occupy non-overlapping frequency bands. For example, the low-band signal 122 and the high-band signal 124 may occupy non-overlapping frequency bands of 50 Hz-7 kHz and 7 kHz-16 kHz. In an alternate embodiment, the low-band signal 122 and the high-band signal 124 may occupy non-overlapping frequency bands of 50 Hz-8 kHz and 8 kHz-16 kHz. In an yet another alternate embodiment, the low-band signal 122 and the high-band signal 124 may overlap (e.g., 50 Hz-8 kHz and 7 kHz-16 kHz), which may enable a low-pass filter and a high-pass filter of the analysis filter bank 110 to have a smooth rolloff, which may simplify design and reduce cost of the low-pass filter and the high-pass filter. Overlapping the low-band signal 122 and the high-band signal 124 may also enable smooth blending of low-band and high-band signals at a receiver, which may result in fewer audible artifacts.

It should be noted that although the example of FIG. 1 illustrates processing of a SWB signal, this is for illustration only. In an alternate embodiment, the input audio signal 102 may be a wideband (WB) signal having a frequency range of approximately 50 Hz to approximately 8 kHz. In such an embodiment, the low-band signal 122 may correspond to a frequency range of approximately 50 Hz to approximately 6.4 kHz and the high-band signal 124 may correspond to a frequency range of approximately 6.4 kHz to approximately 8 kHz. It should also be noted that the various systems and methods herein are described as detecting high-band noise and performing various operations in response to high-band noise. However, this is for example only. The techniques illustrated with reference to FIGS. 1-7 may also be performed in the context of low-band noise.

The system 100 may include a low-band analysis module 130 configured to receive the low-band signal 122. In a particular embodiment, the low-band analysis module 130 may represent an embodiment of a code excited linear prediction (CELP) encoder. The low-band analysis module 130 may include a linear prediction (LP) analysis and coding module 132, a linear prediction coefficient (LPC) to line spectral pair (LSP) transform module 134, and a quantizer 136. LSPs may also be referred to as line spectral frequencies (LSFs), and the two terms may be used interchangeably herein. The LP analysis and coding module 132 may encode a spectral envelope of the low-band signal 122 as a set of LPCs. LPCs may be generated for each frame of audio (e.g., 20 milliseconds (ms) of audio, corresponding to 320 samples at a sampling rate of 16 kHz), each sub-frame of audio (e.g., 5 ms of audio), or any combination thereof. The number of LPCs generated for each frame or sub-frame may be determined by the "order" of the LP analysis performed. In a particular embodiment, the LP analysis and coding module 132 may generate a set of eleven LPCs corresponding to a tenth-order LP analysis.

The LPC to LSP transform module 134 may transform the set of LPCs generated by the LP analysis and coding module 132 into a corresponding set of LSPs (e.g., using a one-to-one transform). Alternately, the set of LPCs may be one-to-one transformed into a corresponding set of parcor coefficients, log-area-ratio values, immittance spectral pairs (ISPs), or immittance spectral frequencies (ISFs). The transform between the set of LPCs and the set of LSPs may be reversible without error.

The quantizer 136 may quantize the set of LSPs generated by the transform module 134. For example, the quantizer 136 may include or be coupled to multiple codebooks that include multiple entries (e.g., vectors). To quantize the set of LSPs, the quantizer 136 may identify entries of codebooks that are "closest to" (e.g., based on a distortion measure such as least squares of mean square error) the set of LSPs. The quantizer 136 may output an index value or series of index values corresponding to the location of the identified entries in the codebooks. The output of the quantizer 136 may thus represent low-band filter parameters that are included in a low-band bit stream 142.

The low-band analysis module 130 may also generate a low-band excitation signal 144. For example, the low-band excitation signal 144 may be an encoded signal that is generated by quantizing a LP residual signal that is generated during the LP process performed by the low-band analysis module 130. The LP residual signal may represent prediction error.

The system 100 may further include a high-band analysis module 150 configured to receive the high-band signal 124 from the analysis filter bank 110 and the low-band excitation signal 144 from the low-band analysis module 130. The high-band analysis module 150 may generate high-band side information 172 based on one or more of the high-band signal 124, the low-band excitation signal 144, or a high-band filtered output 168, such as described in further detail with respect to FIG. 4. For example, the high-band side information 172 may include high-band LSPs and/or gain information (e.g., based on at least a ratio of high-band energy to low-band energy), as further described herein.

The high-band analysis module 150 may include a high-band excitation generator 160. The high-band excitation generator 160 may generate a high-band excitation signal by extending a spectrum of the low-band excitation signal 144 into the high-band frequency range (e.g., 7 kHz-16 kHz). To illustrate, the high-band excitation generator 160 may apply a transform to the low-band excitation signal (e.g., a non-linear transform such as an absolute-value or square operation) and may mix the transformed low-band excitation signal with a noise signal (e.g., white noise modulated according to an envelope corresponding to the low-band excitation signal 144) to generate the high-band excitation signal. The high-band excitation signal may be used by a high-band gain determination module 162 to determine one or more high-band gain parameters that are included in the high-band side information 172.

The high-band analysis module 150 may also include an LP analysis and coding module 152, a LPC to LSP transform module 154, and a quantizer 156. Each of the LP analysis and coding module 152, the transform module 154, and the quantizer 156 may function as described above with reference to corresponding components of the low-band analysis module 130, but at a comparatively reduced resolution (e.g., using fewer bits for each coefficient, LSP, etc.). In another example embodiment, the high band LSP Quantizer 156 may use scalar quantization where a subset of LSP coefficients are quantized individually using a pre-defined number of bits. For example, the LP analysis and coding module 152, the transform module 154, and the quantizer 156 may use the high-band signal 124 to determine high-band filter information (e.g., high-band LSPs) that are included in the high-band side information 172. In a particular embodiment, the high-band side information 172 may include high-band LSPs as well as high-band gain parameters.

The low-band bit stream 142 and the high-band side information 172 may be multiplexed by a multiplexer (MUX) 180 to generate an output bit stream 192. The output bit stream 192 may represent an encoded audio signal corresponding to the input audio signal 102. For example, the output bit stream 192 may be transmitted (e.g., over a wired, wireless, or optical channel) and/or stored. At a receiver, reverse operations may be performed by a demultiplexer (DEMUX), a low-band decoder, a high-band decoder, and a filter bank to generate an audio signal (e.g., a reconstructed version of the input audio signal 102 that is provided to a speaker or other output device). The number of bits used to represent the low-band bit stream 142 may be substantially larger than the number of bits used to represent the high-band side information 172. Thus, most of the bits in the output bit stream 192 represent low-band data. The high-band side information 172 may be used at a receiver to regenerate the high-band excitation signal from the low-band data in accordance with a signal model. For example, the signal model may represent an expected set of relationships or correlations between low-band data (e.g., the low-band signal 122) and high-band data (e.g., the high-band signal 124). Thus, different signal models may be used for different kinds of audio data (e.g., speech, music, etc.), and the particular signal model that is in use may be negotiated by a transmitter and a receiver (or defined by an industry standard) prior to communication of encoded audio data. Using the signal model, the high-band analysis module 150 at a transmitter may be able to generate the high-band side information 172 such that a corresponding high-band analysis module at a receiver is able to use the signal model to reconstruct the high-band signal 124 from the output bit stream 192.

Figure 2:
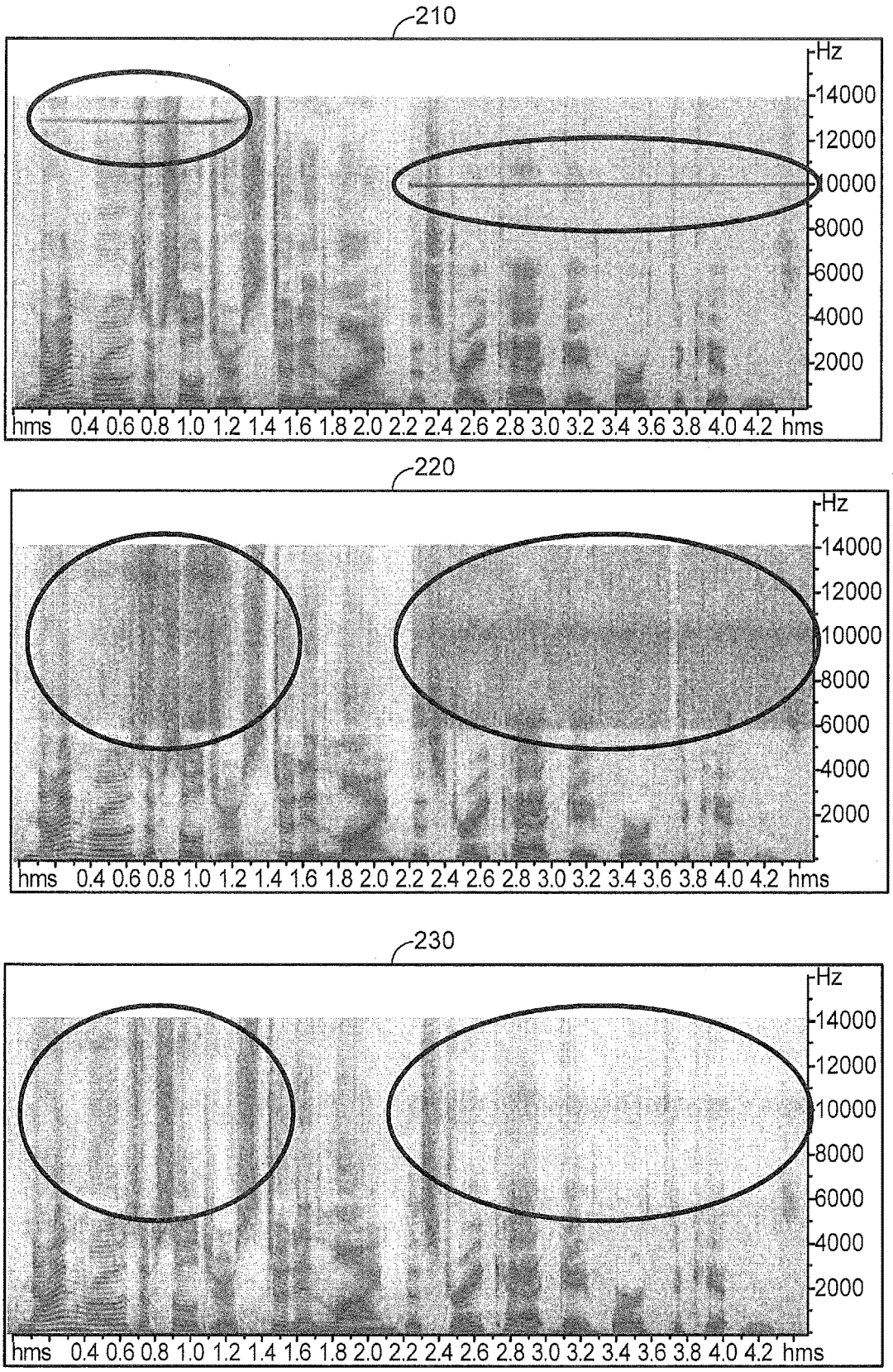
FIG. 2 is a diagram to illustrate an examples of artifact-inducing component, a corresponding reconstructed signal that includes artifacts, and a corresponding reconstructed signal that does not include the artifacts.

In the presence of noise, however, high-band synthesis at the receiver may lead to noticeable artifacts, because insufficient correlation between the low-band and the high-band may cause the underlying signal model to perform sub-optimally in reliable signal reconstruction. For example, the signal model may incorrectly interpret the noise components in high band as speech, and may thus cause generation of gain parameters that attempt to replicate the noise at a receiver, leading to the noticeable artifacts. Examples of such artifact-generating conditions include, but are not limited to, high-frequency noises such as automobile horns and screeching brakes. To illustrate, a first spectrogram 210 in FIG. 2 illustrates an audio signal having components corresponding to artifact-generating conditions, illustrated as high-band noise having a relatively large signal energy. A second spectrogram 220 illustrates the resulting artifacts in the reconstructed signal due to overestimation of gain parameters.

To reduce such artifacts, the high-band analysis module 150 may perform a conditional high-band filtering. For example, the high-band analysis module 150 may include an artifact inducing component detection module 158 that is configured to detect artifact-inducing components, e.g., the artifact-inducing component shown in the first spectrogram 210 of FIG. 2, that are likely to result in audible artifacts upon reproduction. In the presence of such components, a filtering module 166 may perform filtering of the high-band signal 124 to attenuate artifact-generating components. Filtering the high-band signal 124 may result in a reconstructed signal according to a third spectrogram 230 of FIG. 2, which is free of (or has a reduced level of) the artifacts shown in the second spectrogram 220 of FIG. 2.

One or more tests may be performed to evaluate whether an audio signal includes an artifact-generating condition. For example, a first test may include comparing a minimum inter-LSP spacing that is detected in a set of LSPs (e.g., LSPs for a particular frame of the audio signal) to a first threshold. A small spacing between LSPs corresponds to a relatively strong signal at a relatively narrow frequency range. In a particular embodiment, when the high-band signal 124 is determined to result in a frame having a minimum inter-LSP spacing that is less than the first threshold, an artifact-generating condition is determined to be present in the audio signal and filtering may be enabled for the frame.

As another example, a second test may include comparing an average minimum inter-LSP spacing for multiple consecutive frames to a second threshold. For example, when a particular frame of an audio signal has a minimum LSP spacing that is greater than the first threshold but less than a second threshold, an artifact-generating condition may still be determined to be present if an average minimum inter-LSP spacing for multiple frames (e.g., a weighted average of the minimum inter-LSP spacing for the four most recent frames including the particular frame) is smaller than a third threshold. As a result, filtering may be enabled for the particular frame.

As another example, a third test may include determining if a particular frame follows a filtered frame of the audio signal. If the particular frame follows a filtered frame, filtering may be enabled for the particular frame based on the minimum inter-LSP spacing of the particular frame being less than the second threshold.

Three tests are described for illustrative purposes. Filtering for a frame may be enabled in response to any one or more of the tests (or combinations of the tests) being satisfied or in response to one or more other tests or conditions being satisfied. For example, a particular embodiment may include determining whether or not to enable filtering based on a single test, such as the first test described above, without applying either of the second test or the third test. Alternate embodiments may include determining whether or not to enable filtering based on the second test without applying either of the first test or the third test, or based on the third test without applying either of the first test or the second test. As another example, a particular embodiment may include determining whether or not to enable filtering based on two tests, such as the first test and the second test, without applying the third test. Alternate embodiments may include determining whether or not to enable filtering based on the first test and the third test without applying the second test, or based on the second test and the third test without applying the first test.

In a particular embodiment, the artifact inducing component detection module 158 may determine parameters from the audio signal to determine whether an audio signal includes a component that will result in audible artifacts. Examples of such parameters include a minimum inter-LSP spacing and an average minimum inter-LSP spacing. For example, a tenth order LP process may generate a set of eleven LPCs that are transformed to ten LSPs. The artifact inducing component detection module 158 may determine, for a particular frame of audio, a minimum (e.g., smallest) spacing between any two of the ten LSPs. Typically, sharp and sudden noises, such as car horns and screeching brakes, result in closely spaced LSPs (e.g., the "strong" 13 kHz noise component in the first spectrogram 210 may be closely surrounded by LSPs at 12.95 kHz and 13.05 kHz). The artifact inducing component detection module 158 may determine a minimum inter-LSP spacing and an average minimum inter-LSP spacing, as shown in the following C++-style pseudocode that may be executed by or implemented by the artifact inducing component detection module 158.

```
lsp__spacing = 0.5; //default minimum LSP spacing
LPC__ORDER = 10;   //order of linear predictive coding being
performed for ( i = 0; i < LPC__ORDER; i++ )
{ /* Estimate inter-LSP spacing, i.e., LSP distance between the i-th
coefficient and the (i−1)-th LSP coefficient as per below */
   lsp__spacing = min(lsp__spacing, ( i = = 0 ? lsp__shb[0] :
   (lsp__shb[i] − lsp__shb[i −1])));
}
```

The artifact inducing component detection module 158 may further determine a weighted-average minimum inter-LSP spacing in accordance with the following pseudocode. The following pseudocode also includes resetting inter-LSP spacing in response to a mode transition. Such mode transitions may occur in devices that support multiple encoding modes for music and/or speech. For example, the device may use an algebraic CELP (ACELP) mode for speech and an audio coding mode, i.e., a generic signal coding (GSC) for music-type signals. Alternately, in certain low-rate scenarios, the device may determine based on feature parameters (e.g., tonality, pitch drift, voicing, etc.) that an ACELP/GSC/modified discrete cosine transform (MDCT) mode may be used.

```
/* LSP spacing reset during mode transitions, i.e., when last frame's
coding mode is different from current frame's coding mode */
THR1 = 0.008;
if(last__mode != current__mode && lsp__spacing < THR1)
{
   lsp__shb__spacing[0] = lsp__spacing;
   lsp__shb__spacing[1] = lsp__spacing;
   lsp__shb__spacing[2] = lsp__spacing;
   prevPreFilter = TRUE;
}
/* Compute weighted average LSP spacing over current frame and
three previous frames */
WGHT1 = 0.1; WGHT2 = 0.2; WGHT3 = 0.3; WGHT4 = 0.4;
Average__lsp__shb__spacing  =   WGHT1 * lsp__shb__spacing[0] +
                                WGHT2 * lsp__shb__spacing[1] +
                                WGHT3 * lsp__shb__spacing[2] +
                                WGHT4 * lsp__spacing;
/* Update the past lsp spacing buffer */
lsp__shb__spacing[0] = lsp__shb__spacing[1];
lsp__shb__spacing[1] = lsp__shb__spacing[2];
lsp__shb__spacing[2] = lsp__spacing;
```

After determining the minimum inter-LSP spacing and the average minimum inter-LSP spacing, the artifact inducing component detection module 158 may compare the determined values to one or more thresholds in accordance with the following pseudocode to determine whether artifact-inducing noise exists in the frame of audio. When artifact-inducing noise exists, the artifact inducing component detection module 158 may cause the filtering module 166 to perform filtering of the high-band signal 124.

```
THR1 = 0.008; THR2 = 0.0032, THR3 = 0.005;
PreFilter = FALSE;
/* Check for the conditions below and enable filtering parameters
   If LSP spacing is very small, then there is high confidence that
   artifact-inducing noise exists. */
if (lsp_spacing <= THR2 ||
   (lsp_spacing < THR1   &&  (Average_lsp_shb_spacing < THR3 ||
                                 prevPreFilter == TRUE)) )
{
   PreFilter = TRUE;
}
/* Update previous frame gain attenuation flag to be used in the
next frame */
prevPreFilter = PreFilter;
```

In a particular embodiment, the conditional filtering module 166 may selectively perform filtering when artifact-inducing noise is detected. The filtering module 166 may filter the high-band signal 124 prior to determination of one or more gain parameters of the high-band side information 172. For example, the filtering may include finite impulse response (FIR) filtering. In a particular embodiment, the filtering may be performed using adaptive high-band LPCs 164 from the LP analysis and coding module 152 and may generate a high-band filtered output 168. The high-band filtered output 168 may be used to generate at least a portion of the high-band side information 172.

Figure 3:
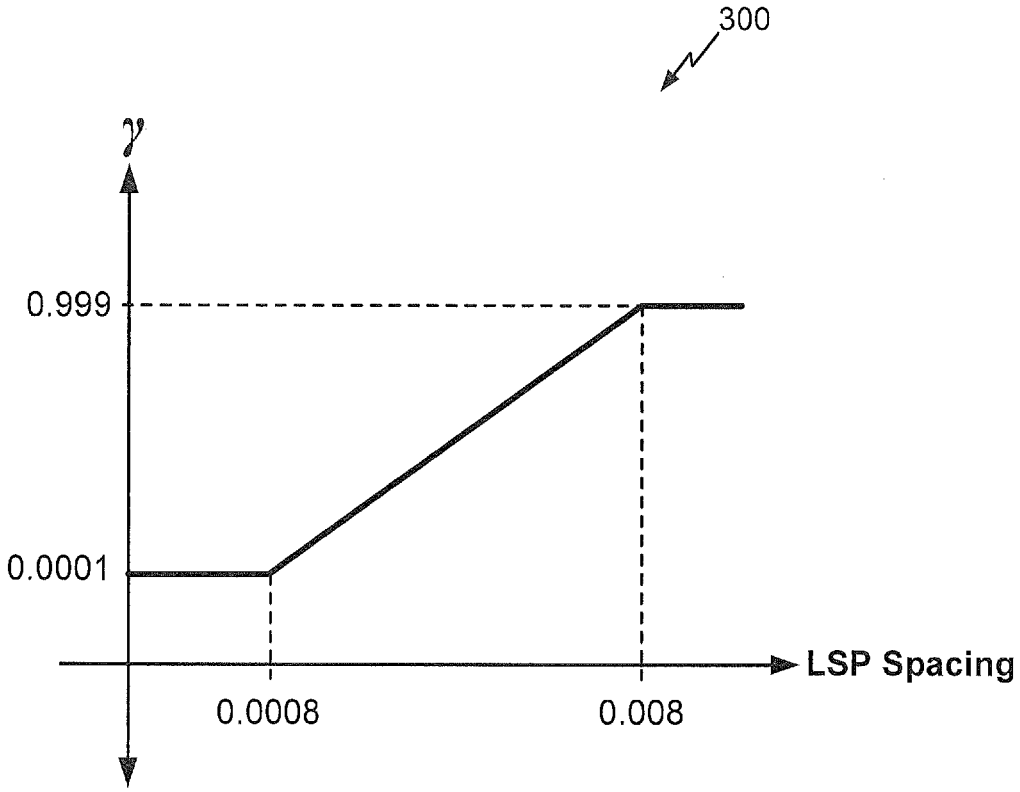
FIG. 3 is a graph to illustrate a particular embodiment of mapping between adaptive weighting factor ($\gamma$) and line spectral pair (LSP) spacing.

In a particular embodiment, the filtering may be performed in accordance with the filtering equation:

$$A\left(\frac{z}{1-\gamma}\right) = 1 - \sum_{i=1}^{L} (1-\gamma)^i a_i z^{-i},$$

where $a_i$ are the high-band LPCs, L is the LPC order (e.g., 10), and γ (gamma) is a weighting parameter. In a particular embodiment, the weighting parameter γ may have a constant value. In other embodiments, the weighting parameter γ may be adaptive and may be determined based on inter-LSP spacing. For example, a value of the weighting parameter γ may be determined from the linear mapping of γ to inter-LSP spacing illustrated by the graph 300 of FIG. 3. As shown in FIG. 3, when inter-LSP spacing is narrow, γ may be small (e.g., equal to 0.0001), resulting in spectral whitening or stronger filtering of the high-band. However, if inter-LSP is large, γ may also be large (e.g., almost equal to 1), resulting in almost no filtering. In a particular embodiment, the mapping of FIG. 3 may be adaptive based on one or more factors, such as the sample rate and frequency at which artifacts are prominent, signal-to-noise ratio (SNR), prediction gain after LP analysis, etc.

Figure 4:
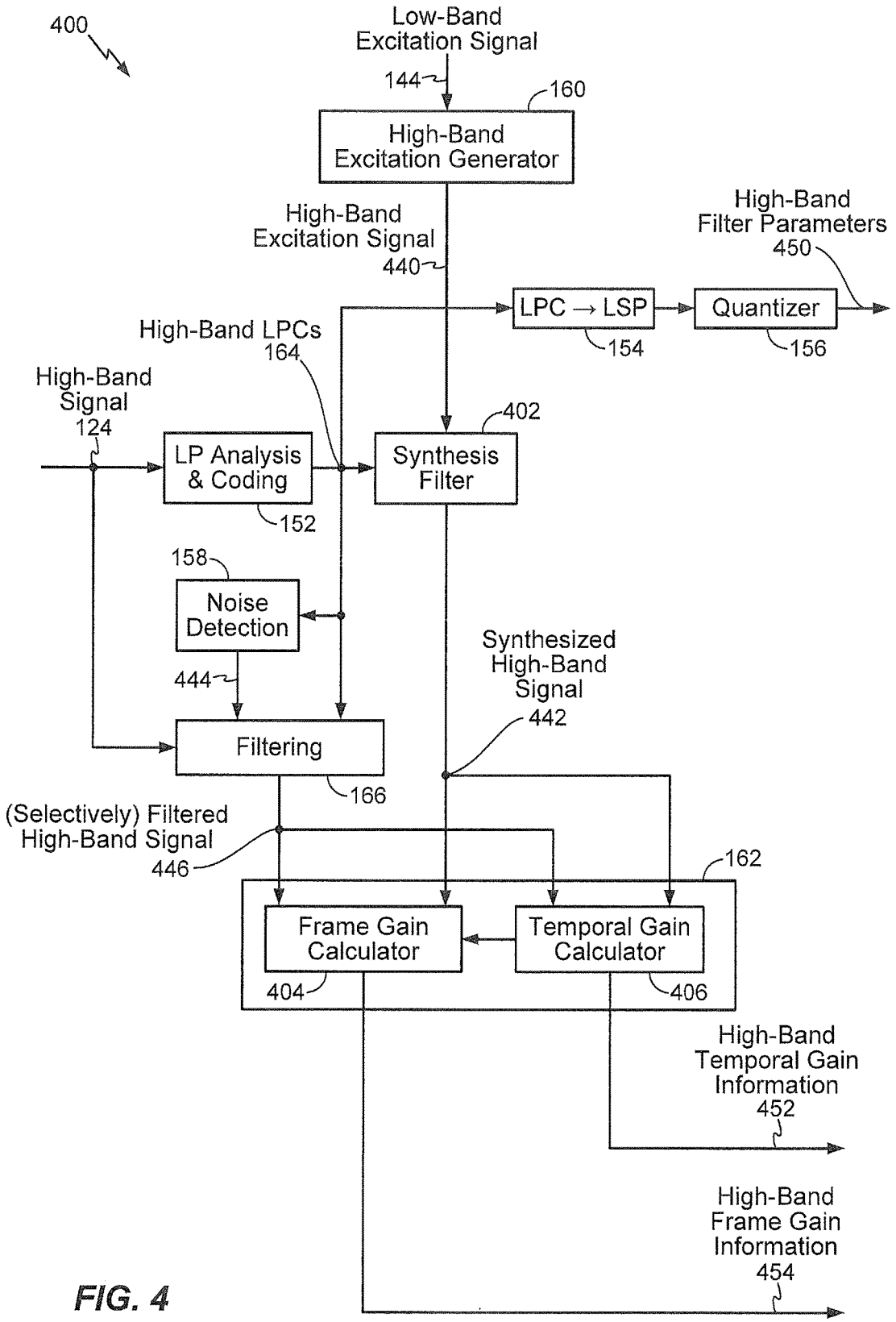
FIG. 4 is a diagram to illustrate another particular embodiment of a system that is operable to perform filtering.

The system 100 of FIG. 1 may thus perform filtering to reduce or prevent audible artifacts due to noise in an input signal. The system 100 of FIG. 1 may thus enable more accurate reproduction of an audio signal in the presence of an artifact generating noise component that is unaccounted for by speech coding signal models, FIG. 4 illustrates an embodiment of a system 400 configured to filter a high-band signal. The system 400 includes the LP analysis and coding module 152, the LPC to LSP transform module 154, the quantizer 156, the artifact inducing component detection module 158, and the filtering module 166 of FIG. 1. The system 400 further includes a synthesis filter 402, a frame gain calculator 404, and a temporal gain calculator 406. In a particular embodiment, the frame gain calculator 404 and the temporal gain calculator 406 are components of the gain determination module 162 of FIG. 1.

The high-band signal 124 (e.g., the high-band portion of the input signal 102 of FIG. 1) is received at the LP analysis and coding module 152, and the LP analysis and coding module 152 generates the high-band LPCs 164, as described with respect to FIG. 1. The high-band LPCs 164 are converted to LSPs at the LPC to LSP transform module 154, and the LSPs are quantized at the quantizer 156 to generate high-band filter parameters 450 (e.g., quantized LSPs).

The synthesis filter 402 is used to emulate decoding of the high-band signal based on the low-band excitation signal 144 and the high-band LPCs 164. For example, the low-band excitation signal 144 may be transformed and mixed with a modulated noise signal at the high-band excitation generator 160 to generate a high-band excitation signal 440. The high-band excitation signal 440 is provided as an input to the synthesis filter 402, which is configured according to the high-band LPCs 164 to generate a synthesized high-band signal 442. Although the synthesis filter 402 is illustrated as receiving the high-band LPCs 164, in other embodiments the LSPs output by the LPC to LSP transformation module 154 may be transformed back to LPCs and provided to the synthesis filter 402. Alternatively, the output of the quantizer 156 may be un-quantized, transformed back to LPCs, and provided to the synthesis filter 402, to more accurately emulate reproduction of the LPCs that occurs at a receiving device.

While the synthesized high-band signal 442 may traditionally be compared to the high-band signal 124 to generate gain information for high-band side information, when the high-band signal 124 includes an artifact-generating component, gain information may be used to attenuate the artifact-generating component by use of a selectively filtered high-band signal 446.

To illustrate, the filtering module 166 may be configured to receive a control signal 444 from the artifact inducing component detection module 158. For example, the control signal 444 may include a value corresponding to a smallest detected inter-LSP spacing, and the filtering module 166 may selectively apply filtering based on the minimum detected inter-LSP spacing to generate a filtered high-band output as the selectively filtered high-band signal 446. As another example, the filtering module 166 may apply filtering to generate a filtered high-band output as the selectively filtered high-band signal 446 using a value of the inter-LSP spacing to determine a value of the weighting factor γ, such as according to the mapping illustrated in FIG. 3. As a result, a selectively and/or adaptively filtered high-band signal 446 may have reduced signal energy as compared to the high-band signal 124 when artifact-generating noise components are detected in the high-band signal 124.

The selectively and/or adaptively filtered high-band signal 446 may be compared to the synthesized high-band signal 442 and/or compared to the low band signal 122 of FIG. 1 at the frame gain calculator 404. The frame gain calculator 404 may generate high-band frame gain information 454 based on the comparison (e.g., an encoded or quantized ratio of energy values, such as a ratio of a first energy corresponding to the filtered high-band output to a second energy corresponding to the low-band signal) to enable a receiver to adjust a frame gain to more closely reproduce the filtered high-band signal 446 during reconstruction of the high-band signal 124. By filtering the high-band signal 124 prior to determining the high-band frame gain information, audible effects of artifacts due to noise in the high-band signal 124 may be attenuated or eliminated.

The synthesized high-band signal 442 may also be provided to the temporal gain calculator 406. The temporal gain calculator 406 may determine a ratio of an energy corresponding to the synthesized high-band signal and/or an energy corresponding to the low band signal 122 of FIG. 1 to an energy corresponding to the filtered high-band signal 446. The ratio may be encoded (e.g., quantized) and provided as high-band temporal gain information 452 corresponding to sub-frame gain estimates. The high-band temporal gain information may enable a receiver to adjust a high-band gain to more closely reproduce a high-band-to-low-band energy ratio of an input audio signal.

The high-band filter parameters 450, the high-band temporal gain information 452, and the high-band frame gain information 454 may collectively correspond to the high-band side information 172 of FIG. 1. Some of the side information, such as the high-band frame gain information 454, may be at least partially based on the filtered signal 446 and at least partially based on the synthesized high-band signal 442. Some of the side information may not be affected by the filtering. As illustrated in FIG. 4, the filtered high-band output of the filter 166 may be used only for determining gain information. To illustrate, the selectively filtered high-band signal 466 is provided only to the high-band gain determination module 162 and is not provided to the LP analysis and coding module 152 for encoding. As a result, the LSPs (e.g., the high-band filter parameters 450) are generated at least partially based on the high-band signal 124 and may not be affected by the filtering.

Figure 5:
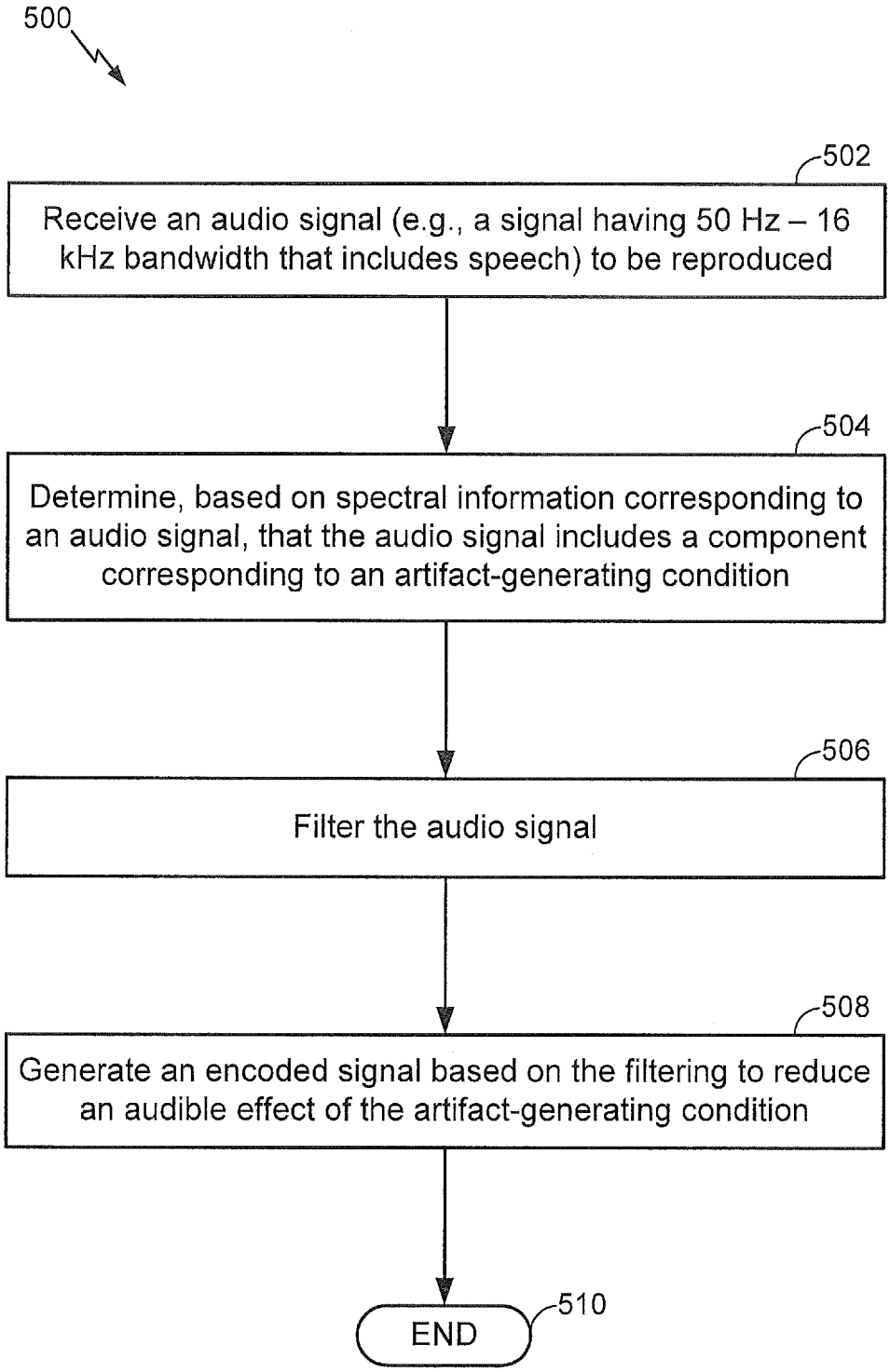
FIG. 5 is a flow chart to illustrate a particular embodiment of a method of performing filtering.

Referring to FIG. 5, a flowchart of a particular embodiment of a method of performing filtering is shown and generally designated 500. In an illustrative embodiment, the method 500 may be performed at the system 100 of FIG. 1 or the system 400 of FIG. 4.

The method 500 may include receiving an audio signal to be reproduced (e.g., a speech coding signal model), at 502. In a particular embodiment, the audio signal may have a bandwidth from approximately 50 Hz to approximately 16 kHz and may include speech. For example, in FIG. 1, the analysis filter bank 110 may receive the input audio signal 102 that is to be reproduced at a receiver.

The method 500 may include determining, based on spectral information corresponding to the audio signal, that the audio signal includes a component corresponding to an artifact-generating condition, at 504. The audio signal may be determined to include the component corresponding to an artifact-generating condition in response to the inter-LSP spacing being less than a first threshold, such as "THR2" in the pseudocode corresponding to FIG. 1. An average inter-LSP spacing may be determined based on the inter-LSP spacing associated with the frame and at least one other inter-LSP spacing associated with at least one other frame of the audio signal. The audio signal may be determined to include the component corresponding to an artifact-generating condition in response to the inter-LSP spacing being less than a second threshold and at least one of: the average inter-LSP spacing being less than a third threshold or a gain attenuation corresponding to another frame of the audio signal being enabled, the other frame preceding the frame of the audio signal.

The method 500 includes filtering the audio signal, at 506. For example, the audio signal may include a low-band portion and a high-band portion, such as the low-band signal 122 and the high-band signal 124 of FIG. 1. Filtering the audio signal may include filtering the high-band portion. The audio signal may be filtered using adaptive linear prediction coefficients (LPCs) associated with a high-band portion of the audio signal to generate a high-band filtered output. For example, the LPCs may be used in conjunction with the weighting parameter $\gamma$ as described with respect to FIG. 1.

As an example, an inter-line spectral pair (LSP) spacing associated with a frame of the audio signal may be determined as a smallest of a plurality of inter-LSP spacings corresponding to a plurality of LSPs generated during linear predictive coding (LPC) of the frame. The method 500 may include determining an adaptive weighting factor based on the inter-LSP spacing and performing the filtering using the adaptive weighting factor. For example, the adaptive weighting factor may be applied to high-band linear prediction coefficients, such as by applying the term $(1-\gamma)^i$ to the linear prediction coefficients $a_i$ as described with respect to the filter equation described with respect to FIG. 1.

The adaptive weighting factor may be determined according to a mapping that associates inter-LSP spacing values to values of the adaptive weighting factor, such as illustrated in FIG. 3. The mapping may be a linear mapping such that a linear relationship exists between a range of inter-LSP spacing values and a range of weighting factor values. Alternatively, the mapping may be non-linear. The mapping may be static (e.g., the mapping of FIG. 3 may apply under all operating conditions) or may be adaptive (e.g., the mapping of FIG. 3 may vary based on operating conditions). For example, the mapping may be adaptive based on at least one of a sample rate or a frequency corresponding to the artifact-generating condition. As another example, the mapping may be adaptive based on a signal-to-noise ratio. As another example, the mapping may be adaptive based on a prediction gain after linear prediction analysis.

The method 500 may include generating an encoded signal based on the filtering to reduce an audible effect of the artifact-generating condition, at 508. The method 500 ends, at 510.

The method 500 may be performed by the system 100 of FIG. 1 or the system 400 of FIG. 4. For example, the input audio signal 102 may be received at the analysis filter bank 110, and the low-band portion and the high-band portion may be generated at the analysis filter bank 110. The low-band analysis module 130 may generate the low-band bit stream 142 based on the low-band portion. The high-band analysis module 150 may generate the high-band side information 172 based on at least one of the high-band portion 124, the low-band excitation signal 144 associated with the low-band portion, or the high-band filtered output 168. The MUX 180 may multiplex the low-band bit stream 142 and the high-band side information 172 to generate the output bit stream 192 corresponding to the encoded signal.

To illustrate, the high-band side information 172 of FIG. 1 may include frame gain information that is generated at least partially based on the high-band filtered output 168 and on the high-band portion, such as described with respect to the high-band frame gain information 454 of FIG. 4. The high-band side information 172 may further include temporal gain information corresponding to sub-frame gain estimates. The temporal gain information may be generated at least partially based on the high-band portion 124 and the high-band filtered output 168, such as described with respect to the high-band temporal gain information 452 of FIG. 4. The high-band side information 172 may include line spectral pairs (LSPs) generated at least partially based on the high-band portion 124, such as described with respect to the high-band filter parameters 450 of FIG. 4.

In particular embodiments, the method 500 of FIG. 5 may be implemented via hardware (e.g., a field-programmable gate array (FPGA) device, an application-specific integrated circuit (ASIC), etc.) of a processing unit such as a central processing unit (CPU), a digital signal processor (DSP), or a controller, via a firmware device, or any combination thereof. As an example, the method 500 of FIG. 5 can be performed by a processor that executes instructions, as described with respect to FIG. 8.

Figure 6:
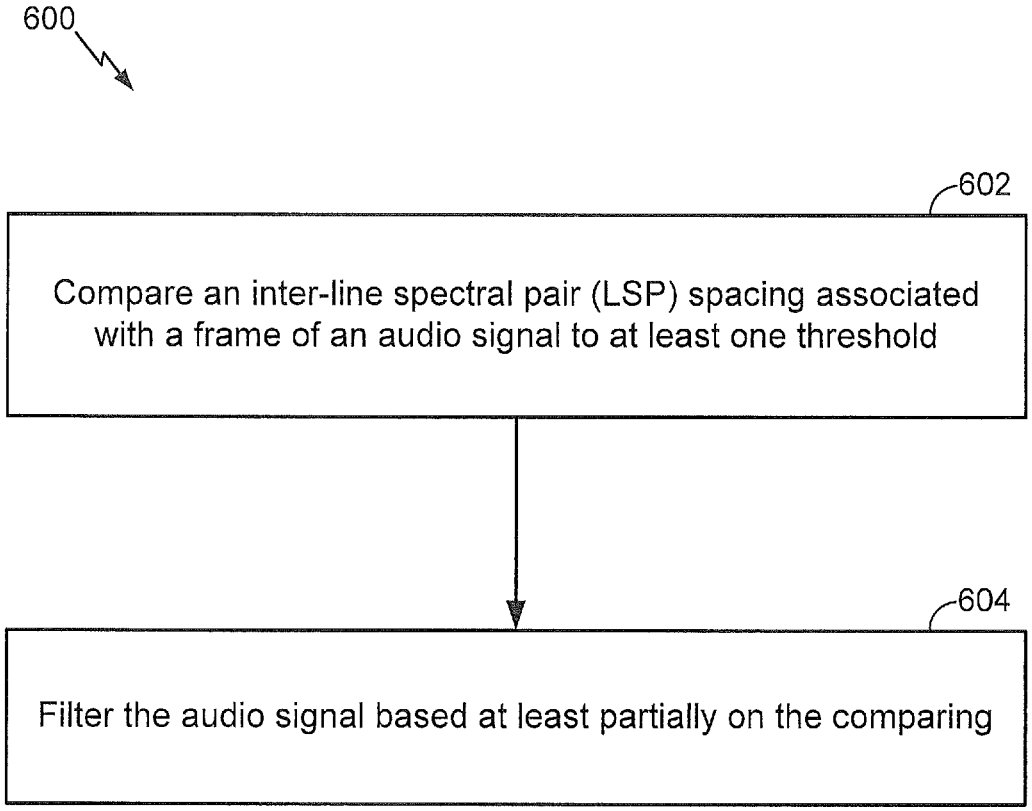
FIG. 6 is a flowchart to illustrate another particular embodiment of a method of performing filtering.

Referring to FIG. 6, a flowchart of a particular embodiment of a method of performing filtering is shown and generally designated 600. In an illustrative embodiment, the method 600 may be performed at the system 100 of FIG. 1 or the system 400 of FIG. 4.

An inter-line spectral pair (LSP) spacing associated with a frame of an audio signal is compared to at least one threshold, at 602, and the audio signal may be filtered based at least partially on a result of the comparing, at 604. Although comparing the inter-LSP spacing to at least one threshold may indicate the presence of an artifact-generating component in the audio signal, the comparison need not indicate, detect, or require the actual presence of an artifact-generating component. For example, one or more thresholds used in the comparison may be set to provide an increased likelihood that gain control is performed when an artifact-generating component is present in the audio signal while also providing an increased likelihood that filtering is performed without an artifact-generating component being present in the audio signal (e.g., a 'false positive'). Thus, the method 600 may perform filtering without determining whether an artifact-generating component is present in the audio signal.

An inter-line spectral pair (LSP) spacing associated with a frame of the audio signal may be determined as a smallest of a plurality of inter-LSP spacings corresponding to a plurality of LSPs generated during linear predictive coding (LPC) of the frame. The audio signal may be filtered in response to the inter-LSP spacing being less than a first threshold. As another example, the audio signal may be filtered in response to the inter-LSP spacing being less than a second threshold and at least one of: an average inter-LSP spacing being less than a third threshold, the average inter-LSP spacing based on the inter-LSP spacing associated with the frame and at least one other inter-LSP spacing associated with at least one other frame of the audio signal, or filtering corresponding to another frame of the audio signal being enabled, the other frame preceding the frame of the audio signal.

Filtering the audio signal may include filtering the audio signal using adaptive linear prediction coefficients (LPCs) associated with a high-band portion of the audio signal to generate high-band filtered output. The filtering may be performed using an adaptive weighting factor. For example, the adaptive weighting factor may be determined based on the inter-LSP spacing, such as the adaptive weighting factor $\gamma$ described with respect to FIG. 3. To illustrate, the adaptive weighting factor may be determined according to a mapping that associates inter-LSP spacing values to values of the adaptive weighting factor. Filtering the audio signal may include applying the adaptive weighting factor to high-band linear prediction coefficients, such as by applying the term $(1-\gamma)^i$ to the linear prediction coefficients $a_i$ as described with respect to the filter equation of FIG. 1.

In particular embodiments, the method 600 of FIG. 6 may be implemented via hardware (e.g., a field-programmable gate array (FPGA) device, an application-specific integrated circuit (ASIC), etc.) of a processing unit such as a central processing unit (CPU), a digital signal processor (DSP), or a controller, via a firmware device, or any combination thereof. As an example, the method 600 of FIG. 6 can be performed by a processor that executes instructions, as described with respect to FIG. 8.

Figure 7:
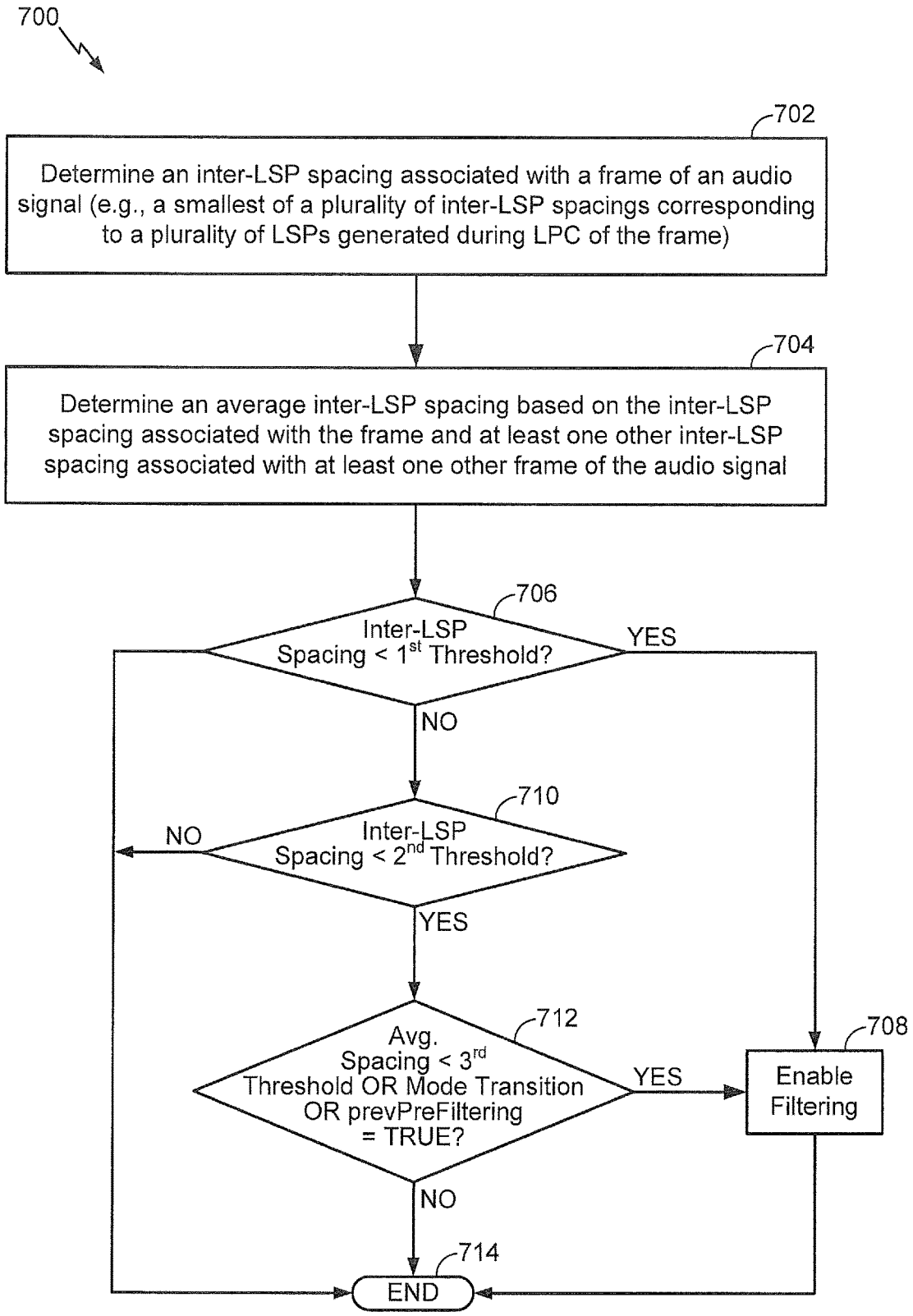
FIG. 7 is a flowchart to illustrate another particular embodiment of a method of performing filtering.

Referring to FIG. 7, a flowchart of another particular embodiment of a method of performing filtering is shown and generally designated 700. In an illustrative embodiment, the method 700 may be performed at the system 100 of FIG. 1 or the system 400 of FIG. 4.

The method 700 may include determining an inter-LSP spacing associated with a frame of an audio signal, at 702. The inter-LSP spacing may be the smallest of a plurality of inter-LSP spacings corresponding to a plurality of LSPs generated during a linear predictive coding of the frame. For example, the inter-LSP spacing may be determined as illustrated with reference to the "lsp_spacing" variable in the pseudocode corresponding to FIG. 1.

The method 700 may also include determining an average inter-LSP spacing based on the inter-LSP spacing associated with the frame and at least one other inter-LSP spacing associated with at least one other frame of the audio signal, at 704. For example, the average inter-LSP spacing may be determined as illustrated with reference to the "Average_lsp_shb_spacing" variable in the pseudocode corresponding to FIG. 1.

The method 700 may include determining whether the inter-LSP spacing is less than a first threshold, at 706. For example, in the pseudocode of FIG. 1, the first threshold may be "THR2"=0.0032. When the inter-LSP spacing is less than the first threshold, the method 700 may include enabling filtering, at 708, and may end, at 714.

When the inter-LSP spacing is not less than the first threshold, the method 700 may include determining whether the inter-LSP spacing is less than a second threshold, at 710. For example, in the pseudocode of FIG. 1, the second threshold may be "THR1"=0.008. When the inter-LSP spacing is not less than the second threshold, the method 700 may end, at 714. When the inter-LSP spacing is less than the second threshold, the method 700 may include determining whether the average inter-LSP spacing is less than a third threshold, or if the frame represents (or is otherwise associated with) a mode transition, or if filtering was performed for a preceding frame, at 712. For example, in the pseudocode of FIG. 1, the third threshold may be "THR3"=0.005. When the average inter-LSP spacing is less than the third threshold, or the frame represents a mode transition, or filtering was performed for a preceding frame, the method 700 enables filtering, at 708, and then ends, at 714. When the average inter-LSP spacing is not less than the third threshold and the frame does not represent a mode transition and filtering is not performed for a preceding frame, the method 700 ends, at 714.

In particular embodiments, the method 700 of FIG. 7 may be implemented via hardware (e.g., a field-programmable gate array (FPGA) device, an application-specific integrated circuit (ASIC), etc.) of a processing unit such as a central processing unit (CPU), a digital signal processor (DSP), or a controller, via a firmware device, or any combination thereof. As an example, the method 700 of FIG. 7 can be performed by a processor that executes instructions, as described with respect to FIG. 8.

Figure 8:
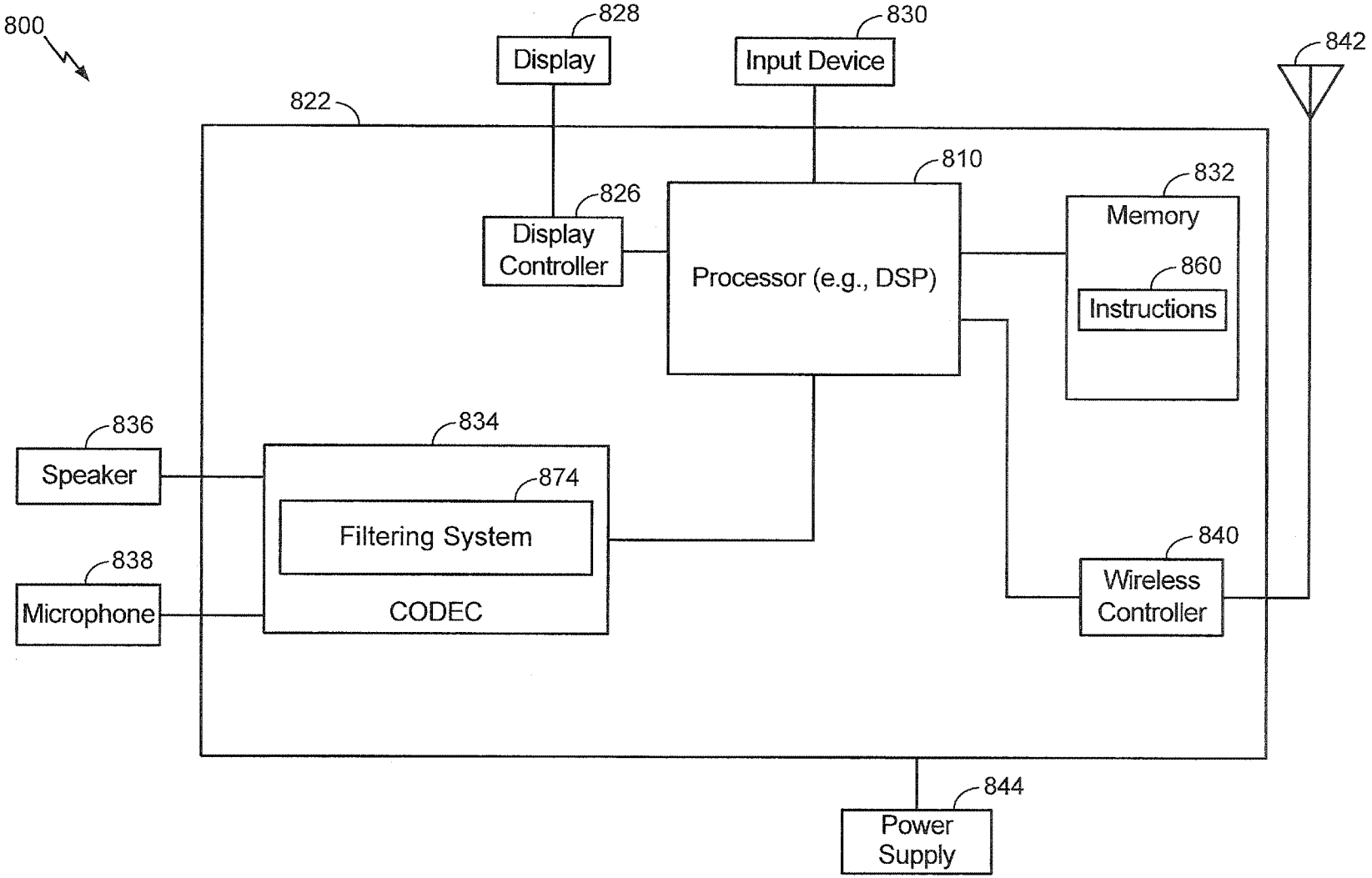
FIG. 8 is a block diagram of a wireless device operable to perform signal processing operations in accordance with the systems and methods of FIGS. 1-7.

Referring to FIG. 8, a block diagram of a particular illustrative embodiment of a wireless communication device is depicted and generally designated 800. The device 800 includes a processor 810 (e.g., a central processing unit (CPU), a digital signal processor (DSP), etc.) coupled to a memory 832. The memory 832 may include instructions 860 executable by the processor 810 and/or a coder/decoder (CODEC) 834 to perform methods and processes disclosed herein, such as the methods of FIGS. 5-7.

The CODEC 834 may include a filtering system 874. In a particular embodiment, the filtering system 874 may include one or more components of the system 100 of FIG. 1. The filtering system 874 may be implemented via dedicated hardware (e.g., circuitry), by a processor executing instructions to perform one or more tasks, or a combination thereof. As an example, the memory 832 or a memory in the CODEC 834 may be a memory device, such as a random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). The memory device may include instructions (e.g., the instructions 860) that, when executed by a computer (e.g., a processor in the CODEC 834 and/or the processor 810), cause the computer to determine, based on spectral information corresponding to an audio signal, that the audio signal includes a component corresponding to an artifact-generating condition, to filter the audio signal, and to generate an encoded signal based on the filtering. As an example, the memory 832, or a memory in the CODEC 834, may be a non-transitory computer-readable medium that includes instructions (e.g., the instructions 860) that, when executed by a computer (e.g., a processor in the CODEC 834 and/or the processor 810), cause the computer to compare an inter-line spectral pair (LSP) spacing associated with a frame of an audio signal to at least one threshold and to filter the audio signal based at least partially on the comparing.

FIG. 8 also shows a display controller 826 that is coupled to the processor 810 and to a display 828. The CODEC 834 may be coupled to the processor 810, as shown. A speaker 836 and a microphone 838 can be coupled to the CODEC 834. For example, the microphone 838 may generate the input audio signal 102 of FIG. 1, and the CODEC 834 may generate the output bit stream 192 for transmission to a receiver based on the input audio signal 102. As another example, the speaker 836 may be used to output a signal reconstructed by the CODEC 834 from the output bit stream 192 of FIG. 1, where the output bit stream 192 is received from a transmitter. FIG. 8 also indicates that a wireless controller 840 can be coupled to the processor 810 and to a wireless antenna 842.

In a particular embodiment, the processor 810, the display controller 826, the memory 832, the CODEC 834, and the wireless controller 840 are included in a system-in-package or system-on-chip device (e.g., a mobile station modem (MSM)) 822. In a particular embodiment, an input device 830, such as a touchscreen and/or keypad, and a power supply 844 are coupled to the system-on-chip device 822. Moreover, in a particular embodiment, as illustrated in FIG. 8, the display 828, the input device 830, the speaker 836, the microphone 838, the wireless antenna 842, and the power supply 844 are external to the system-on-chip device 822. However, each of the display 828, the input device 830, the speaker 836, the microphone 838, the wireless antenna 842, and the power supply 844 can be coupled to a component of the system-on-chip device 822, such as an interface or a controller.

In conjunction with the described embodiments, an apparatus is disclosed that includes means for means for determining, based on spectral information corresponding to an audio signal, that the audio signal includes a component corresponding to an artifact-generating condition. For example, the means for determining may include the artifact inducing component detection module 158 of FIG. 1 or FIG. 4, the filtering system 874 of FIG. 8 or a component thereof, one or more devices configured to determine that an audio signal includes such a component (e.g., a processor executing instructions at a non-transitory computer readable storage medium), or any combination thereof.

The apparatus may also include means for filtering the audio signal responsive to the means for determining. For example, the means for filtering may include the filtering module 168 of FIG. 1 or FIG. 4, the filtering system 874 of FIG. 8, or a component thereof, one or more devices configured to filter a signal (e.g., a processor executing instructions at a non-transitory computer readable storage medium), or any combination thereof.

The apparatus may also include means for generating an encoded signal based on the filtered audio signal to reduce an audible effect of the artifact-generating condition. For example, the means for generating may include the high-band analysis module 150 of FIG. 1, or more components of the system 400 of FIG. 4, the filtering system 874 of FIG. 8, or a component thereof, one or more devices configured to generate an encoded signal based on the filtered audio signal (e.g., a processor executing instructions at a non-transitory computer readable storage medium), or any combination thereof.

Those of skill would further appreciate that the various illustrative logical blocks, configurations, modules, circuits, and algorithm steps described in connection with the embodiments disclosed herein may be implemented as electronic hardware, computer software executed by a processing device such as a hardware processor, or combinations of both. Various illustrative components, blocks, configurations, modules, circuits, and steps have been described above generally in terms of their functionality. Whether such functionality is implemented as hardware or executable software depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the embodiments disclosed herein may be embodied directly in hardware, in a software module executed by a processor, or in a combination of the two. A software module may reside in a memory device, such as random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). An exemplary memory device is coupled to the processor such that the processor can read information from, and write information to, the memory device. In the alternative, the memory device may be integral to the processor. The processor and the storage medium may reside in an application-specific integrated circuit (ASIC). The ASIC may reside in a computing device or a user terminal. In the alternative, the processor and the storage medium may reside as discrete components in a computing device or a user terminal.

The previous description of the disclosed embodiments is provided to enable a person skilled in the art to make or use the disclosed embodiments. Various modifications to these embodiments will be readily apparent to those skilled in the art, and the principles defined herein may be applied to other embodiments without departing from the scope of the disclosure. Thus, the present disclosure is not intended to be limited to the embodiments shown herein but is to be accorded the widest scope possible consistent with the principles and novel features as defined by the following claims.

What is claimed is:

1. A method comprising:

determining a minimum inter-line spectral pair (LSP) spacing of high-band LSPs in a frame of an audio signal that includes a low-band portion and a high-band portion;

based on the minimum inter-LSP spacing, determining whether the audio signal includes a component corresponding to an artifact-generating condition, wherein the minimum inter-LSP spacing corresponds to a difference between a first value corresponding to a first LSP coefficient of the frame and a second value corresponding to a second LSP coefficient of the frame;

conditioned on the audio signal including the component, filtering the high-band portion of the audio signal to generate a filtered high-band output;

determining gain information based on a ratio of a first energy corresponding to the filtered high-band output to a second energy corresponding to at least one of a synthesized high-band signal or the low-band portion of the audio signal; and outputting high-band side information based on at least one of the high-band portion of the audio signal, a low-band excitation signal associated with the low-band portion of the audio signal, or the filtered high-band output, the high-band side information indicating frame gain information, the high-band LSPs, and temporal gain information corresponding to sub-frame gain estimates based on the filtered high-band output.

2. The method of claim 1, wherein the low-band excitation signal includes a harmonically-extended low-band excitation signal, wherein the first LSP coefficient is adjacent to the second LSP coefficient in the frame, and wherein determining the gain information based on the ratio reduces an audible effect of the artifact-generating condition.

3. The method of claim 1, wherein the gain information is determined based on x/y, where x and y correspond to the first energy and the second energy, respectively, and wherein the high-band portion of the audio signal is filtered using linear prediction coefficients (LPCs) associated with the high-band portion of the audio signal to generate the filtered high-band output.

4. The method of claim 3, further comprising:

receiving the audio signal;

generating the low-band portion of the audio signal and the high-band portion of the audio signal at an analysis filter bank;

generating a low-band bit stream based on the low-band portion of the audio signal;

generating the high-band side information; and multiplexing the low-band bit stream and the high-band side information to generate an output bit stream corresponding to an encoded signal.

5. The method of claim 1, wherein the first LSP coefficient and the second LSP coefficients are adjacent LSP coefficients in a single frame of the audio signal.

6. The method of claim 1, wherein the minimum inter-LSP spacing is a smallest of a plurality of inter-LSP spacings corresponding to a plurality of LSPs generated during linear predictive coding (LPC) of the frame.

7. The method of claim 1, wherein the high-band portion of the audio signal is filtered using an adaptive weighting factor, and wherein the method further comprises determining the adaptive weighting factor based on the minimum inter-LSP spacing.

8. The method of claim 7, wherein filtering the high-band portion of the audio signal includes applying the adaptive weighting factor to high-band linear prediction coefficients.

9. The method of claim 7, wherein a value of the adaptive weighting factor is determined according to a mapping that associates inter-LSP spacing values to values of the adaptive weighting factor.

10. The method of claim 9, wherein the mapping is adaptive based on a prediction gain after linear prediction analysis or based on a signal-to-noise ratio.

11. The method of claim 9, wherein the mapping is a linear mapping.

12. The method of claim 9, wherein the mapping is adaptive based on at least one of a sample rate or a frequency corresponding to the artifact-generating condition.

13. The method of claim 1, wherein determining the gain information based on the ratio reduces an audible effect of the artifact-generating condition.

14. The method of claim 1, wherein determining the minimum inter-LSP spacing, determining whether the audio signal includes the component, filtering the high-band portion of the audio signal, and outputting the high-band side information are performed in a device that comprises a fixed location communication device.

15. The method of claim 1, further comprising determining an average inter-LSP spacing based on an inter-LSP spacing associated with the frame and at least one other inter-LSP spacing associated with at least one other frame of the audio signal.

16. The method of claim 15, wherein the audio signal is determined to include the component in response to:

the inter-LSP spacing being less than or equal to a first threshold, the inter-LSP spacing being less than a second threshold and the average inter-LSP spacing being less than a third threshold, or the inter-LSP spacing being less than a second threshold and filtering corresponding to another frame of the audio signal being enabled, the other frame preceding the frame of the audio signal.

17. The method of claim 1, wherein determining the minimum inter-LSP spacing, determining whether the high-band portion of the audio signal includes the component, filtering the high-band portion of the audio signal, and outputting the high-band side information are performed in a device that comprises a mobile communication device.

18. A method comprising:

detecting a minimum inter-line spectral pair (LSP) spacing of high-band LSPs in a frame of an audio signal, wherein the minimum inter-LSP spacing corresponds to a difference between a first value corresponding to a first LSP coefficient of the frame and a second value corresponding to a second LSP coefficient of the frame;

filtering a high-band portion of the audio signal, conditioned on the audio signal including a component corresponding to an artifact-generating condition, to generate a filtered high-band output;

determining gain information based on a ratio of a first energy corresponding to the filtered high-band output to a second energy corresponding to at least one of a synthesized high-band signal or a low-band portion of the audio signal; and outputting high-band side information based on at least one of the high-band portion of the audio signal, a low-band excitation signal associated with a low-band portion of the audio signal, or the filtered high-band output, the high-band side information indicating frame gain information, the high-band LSPs, and temporal gain information corresponding to sub-frame gain estimates based on the filtered high-band output.

19. The method of claim 18, wherein the low-band excitation signal includes a harmonically-extended low-band excitation signal, wherein the gain information is determined based on x/y, where x and y correspond to the first energy and the second energy, respectively, and wherein the minimum inter-LSP spacing is determined to be a smallest of a plurality of inter-LSP spacings corresponding to a plurality of LSPs generated during linear predictive coding (LPC) of the frame.

20. The method of claim 18, wherein the first LSP coefficient and the second LSP coefficient are adjacent LSP coefficients in a single frame of the audio signal.

21. The method of claim 18, wherein the high-band portion of the audio signal is filtered in response to:

an inter-LSP spacing associated with the frame being less than or equal to a first threshold, the inter-LSP spacing being less than a second threshold and an average inter-LSP spacing being less than a third threshold, the average inter-LSP spacing based on the inter-LSP spacing and at least one other inter-LSP spacing associated with at least one other frame of the audio signal, or the inter-LSP spacing being less than a second threshold and filtering corresponding to another frame of the audio signal being enabled, the other frame preceding the frame of the audio signal.

22. The method of claim 18, wherein detecting the minimum inter-LSP spacing, filtering the high-band portion of the audio signal, and determining gain information, and outputting the high-band side information are performed in a device that comprises a mobile communication device.

23. The method of claim 18, further comprising determining a value of an adaptive weighting factor based on the minimum inter-LSP spacing, wherein the filtering of the high-band portion of the audio signal uses linear prediction coefficients (LPCs) associated with the high-band portion of the audio signal and uses the value of the adaptive weighting factor.

24. The method of claim 18, further comprising determining a value of an adaptive weighting factor according to a mapping that associates inter-LSP spacing values to values of the adaptive weighting factor, wherein the filtering of the high-band portion of the audio signal includes applying the adaptive weighting factor to high-band linear prediction coefficients.

25. The method of claim 18, wherein detecting the minimum inter-LSP spacing, filtering the high-band portion of the audio signal, and determining gain information, and outputting the high-band side information are performed in a device that comprises a fixed location communication device.

26. An apparatus comprising:

a noise detection circuit configured to determine a minimum inter-line spectral pair (LSP) spacing of high-band LSPs in a frame of an audio signal that includes a low-band portion and a high-band portion and to determine, based on the minimum inter-LSP spacing, whether the audio signal includes a component corresponding to an artifact-generating condition, wherein the minimum inter-LSP spacing corresponds to a difference between a first value corresponding to a first LSP coefficient of the frame and a second value corresponding to a second LSP coefficient of the frame;

a filtering circuit responsive to the noise detection circuit and configured to filter the high-band portion of the audio signal, conditioned on the audio signal including the component, to generate a filtered high-band output;

a gain determination circuit configured to determine gain information based on a ratio of a first energy corresponding to the filtered high-band output to a second energy corresponding to at least one of a synthesized high-band signal or the low-band portion of the audio signal; and an output terminal configured to generate a high-band side information based on at least one of the high-band portion of the audio signal, a low-band excitation signal associated with the low-band portion of the audio signal, or the filtered high-band output, the high-band side information indicating frame gain information, the high-band LSPs, and temporal gain information corresponding to sub-frame gain estimates based on the filtered high-band output.

27. The apparatus of claim 26, wherein the first LSP coefficient is adjacent to the second LSP coefficient in the frame, and further comprising:

an analysis filter bank configured to generate the low-band portion of the audio signal and the high-band portion of the audio signal;

a low-band analysis module configured to generate a low-band bit stream based on the low-band portion of the audio signal; and a high-band analysis module configured to generate the high-band side information, wherein the output terminal is coupled to a multiplexer configured to multiplex the low-band bit stream and the high-band side information to generate an output bit stream, the output bit stream corresponding to an encoded signal.

28. The apparatus of claim 27, wherein: the frame gain information is generated based on the high-band portion of the audio signal, the noise detection circuit is configured to determine the minimum inter-LSP spacing, the minimum inter-LSP spacing is a smallest of a plurality of inter-LSP spacings corresponding to a plurality of LSPs generated during linear predictive coding (LPC) of the frame, the filtering circuit is configured to apply an adaptive weighting factor to high-band LPCs, and the adaptive weighting factor is determined based on the minimum inter-LSP spacing.

29. The apparatus of claim 26, wherein the gain determination circuit is configured to determine the gain information based on x/y, where x and y correspond to the first energy and the second energy, respectively, and further comprising:

an antenna; and a receiver coupled to the antenna and configured to receive the audio signal.

30. The apparatus of claim 29, wherein the noise detection circuit, the filtering circuit, the gain determination circuit, the output terminal, the receiver, and the antenna are integrated into a mobile communication device.

31. The apparatus of claim 29, wherein the gain information is configured to reduce an audible effect of the artifact-generating condition, and wherein the noise detection circuit, the filtering circuit, the gain determination circuit, the output terminal, the receiver, and the antenna are integrated into a fixed location communication device.

32. The apparatus of claim 26, wherein the first LSP coefficient and the second LSP coefficient are adjacent LSP coefficients in a single frame of the audio signal.

33. An apparatus comprising:

means for determining a minimum inter-line spectral pair (LSP) spacing of high-band LSPs in a frame of an audio signal that includes a low-band portion and a high-band portion;

means for determining, based on the minimum inter-LSP spacing, whether the audio signal includes a component corresponding to an artifact-generating condition, wherein the minimum inter-LSP spacing corresponds to a difference between a first value corresponding to a first LSP coefficient of the frame and a second value corresponding to a second LSP coefficient of the frame;

means for filtering a high-band portion of the audio signal, conditioned on the audio signal including the component, to generate a filtered high-band output;

means for determining gain information based on a ratio of a first energy corresponding to the filtered high-band output to a second energy corresponding to at least one of a synthesized high-band signal or the low-band portion of the audio signal; and means for outputting high-band side information based on at least one of the high-band portion of the audio signal, a low-band excitation signal associated with the low-band portion of the audio signal, or the filtered high-band output, the high-band side information indicating frame gain information, the high-band LSPs, and temporal gain information corresponding to sub-frame gain estimates based on the filtered high-band output.

34. The apparatus of claim 33, wherein the first LSP coefficient is adjacent to the second LSP coefficient in the frame, and further comprising:

means for generating the low-band portion of the audio signal and the high-band portion of the audio signal;

means for generating a low-band bit stream based on the low-band portion of the audio signal;

means for generating the high-band side information; and means for multiplexing the low-band bit stream and the high-band side information to generate an output bit stream corresponding to an encoded signal.

35. The apparatus of claim 33, wherein the means for determining gain information is configured to determine the gain information based on x/y, where x and y correspond to the first energy and the second energy, respectively, wherein the gain information is configured to reduce an audible effect of the artifact-generating condition, and wherein the means for determining whether the audio signal includes the component, the means for filtering, the means for determining gain information, and the means for outputting are integrated into a mobile communication device.

36. The apparatus of claim 33, wherein the minimum inter-LSP spacing is a smallest of a plurality of inter-LSP spacings corresponding to a plurality of LSPs generated during linear predictive coding (LPC) of the frame.

37. The apparatus of claim 33, wherein the gain information is configured to reduce an audible effect of the artifact-generating condition, and wherein the means for determining whether the audio signal includes the component, the means for filtering, the means for determining gain information, and the means for outputting are integrated into a fixed location communication device.

38. A non-transitory computer-readable medium storing instructions that, when executed by a computer, cause the computer to:

determine a minimum inter-line spectral pair (LSP) spacing of high-band LSPs in a frame of an audio signal that includes a low-band portion and a high-band portion;

determine, based on the minimum inter-LSP spacing, whether the audio signal includes a component corresponding to an artifact-generating condition, wherein the minimum inter-LSP spacing corresponds to a difference between a first value corresponding to a first LSP coefficient of the frame and a second value corresponding to a second LSP coefficient of the frame;

filter the high-band portion of the audio signal, conditioned on the audio signal including the component, to generate a filtered high-band output;

determining gain information based on a ratio of a first energy corresponding to the filtered high-band output to a second energy corresponding to at least one of a synthesized high-band signal or the low-band portion of the audio signal; and output high-band side information based on at least one of the high-band portion of the audio signal, a low-band excitation signal associated with the low-band portion of the audio signal, or the filtered high-band output, the high-band side information indicating frame gain information, the high-band LSPs, and temporal gain information corresponding to sub-frame gain estimates based on the filtered high-band output.

39. The non-transitory computer-readable medium of claim 38, wherein the instructions cause the computer to:

filter the high-band portion of the audio signal using linear prediction coefficients (LPCs) associated with the high-band portion of the audio signal, and determine the gain information based on x/y, where x and y correspond to the first energy and the second energy, respectively.

40. The non-transitory computer-readable medium of claim 38, wherein the first LSP coefficient and the second LSP coefficient are adjacent LSP coefficients in a single frame of the audio signal.

* * * * *